US012161226B2

(12) United States Patent
Gallegos

(10) Patent No.: US 12,161,226 B2
(45) Date of Patent: Dec. 10, 2024

(54) FULL BODY SIDE SLEEP PILLOW AND METHODS

(71) Applicant: The Boppy Company, LLC, Golden, CO (US)

(72) Inventor: Sarah Lynne Gallegos, Lakewood, CO (US)

(73) Assignee: The Boppy Company, LLC, Golden, CO (US)

( * ) Notice: Subject to any disclaimer, the term of this patent is extended or adjusted under 35 U.S.C. 154(b) by 0 days.

(21) Appl. No.: 18/184,259

(22) Filed: Mar. 15, 2023

(65) Prior Publication Data

US 2023/0337833 A1 Oct. 26, 2023

Related U.S. Application Data

(63) Continuation of application No. 17/726,221, filed on Apr. 21, 2022, now Pat. No. 11,607,052.

(51) Int. Cl.
*A47C 20/02* (2006.01)
*A47G 9/02* (2006.01)

(52) U.S. Cl.
CPC ..... *A47C 20/02* (2013.01); *A47G 9/0253* (2013.01)

(58) Field of Classification Search
CPC ..... A47C 20/02; A47C 20/025; A47G 9/0253
See application file for complete search history.

(56) References Cited

U.S. PATENT DOCUMENTS 2,336,707 A * 12/1943 Thompson ..... A47C 7/383 5/636
2,473,136 A 6/1949 Brose et al.
D159,483 S * 8/1950 Glassman ..... 5/655
2,562,725 A 7/1951 Leto et al.
(Continued)

FOREIGN PATENT DOCUMENTS

CN 201468760 U * 5/2010 ..... A47C 20/025
CN 204120694 U * 1/2015
(Continued)

OTHER PUBLICATIONS

Leachco, "Back 'N Belly®" Product Specification from company website, Accessed on May 4, 2022, Retrieved from https://leachco.com/collections/leachco-catalog/products/back-n-belly-chic-supreme 4 pages.

(Continued)

*Primary Examiner* — Eric J Kurilla
(74) *Attorney, Agent, or Firm* — Kilpatrick Townsend & Stockton LLP

(57) ABSTRACT

A pillow system includes a body pillow, a torso pillow, and a slipcover that is positionable over the body pillow and torso pillow. The slipcover includes an upper portion, a lower portion, a central portion positioned between the upper portion and the lower portion, a pocket, and an elongate material band that operably connects the pocket with the central portion of the slipcover. The slipcover is designed to enclose the body pillow and the pocket is designed to enclose the torso pillow. The pocket is extendable from the slipcover to position the torso pillow distally of the body pillow and thereby enable a user to lay atop the material band with the torso pillow and body pillow positioned on opposite sides of the user's body.

20 Claims, 7 Drawing Sheets

(56) References Cited

U.S. PATENT DOCUMENTS 3,327,330 A * 6/1967 McCullough ..... A47G 9/10 5/636
3,849,810 A 11/1974 Degen
4,624,021 A * 11/1986 Hofstetter ..... A47D 13/08 5/632
5,097,551 A * 3/1992 Smith ..... A47G 9/10 5/652
5,261,134 A 11/1993 Matthews
D365,241 S 12/1995 Braden
5,661,861 A 9/1997 Matthews
6,038,720 A 3/2000 Matthews et al.
6,055,687 A 5/2000 Matthews
6,119,873 A 9/2000 Matthews
6,279,185 B1 8/2001 Matthews
6,321,403 B1 11/2001 Matthews
6,412,128 B1 7/2002 Matthews
6,434,770 B2 8/2002 Matthews Brown
6,453,493 B1 9/2002 Matthews Brown
6,523,200 B2 2/2003 Brown
6,532,612 B2 3/2003 Matthews Brown
6,625,828 B2 9/2003 Matthews Brown
6,640,977 B2 11/2003 Matthews Brown et al.
6,671,908 B2 1/2004 Brown et al.
6,685,024 B1 2/2004 Matthews
6,763,539 B1 7/2004 Bartley et al.
6,851,143 B2 2/2005 Matthews Brown
6,857,150 B2 2/2005 Matthews Brown et al.
6,874,183 B1 * 4/2005 Taylor ..... A47C 20/027 5/652
6,944,898 B2 9/2005 Matthews Brown et al.
7,000,274 B2 2/2006 Matthews Brown et al.
7,000,275 B2 2/2006 Matthews Brown et al.
7,000,766 B2 2/2006 Matthews Brown et al.
7,010,821 B1 * 3/2006 Leach ..... A47D 13/083 5/636
7,017,212 B2 3/2006 Matthews Brown
7,055,196 B2 6/2006 Littlehorn
7,089,617 B1 8/2006 Lauro
7,089,639 B2 8/2006 Matthews Brown et al.
7,127,760 B2 10/2006 Bartley et al.
7,146,663 B2 12/2006 Brown et al.
7,290,303 B2 11/2007 Mead et al.
7,331,073 B2 2/2008 Littlehorn et al.
7,353,552 B2 * 4/2008 Leach ..... A47C 20/021 5/652
7,404,222 B2 7/2008 Tidwell
7,430,774 B2 10/2008 Littlehorn et al.
7,451,508 B2 11/2008 Matthews Brown et al.
7,472,443 B2 1/2009 Littlehorn et al.
7,587,773 B2 9/2009 Littlehorn et al.
7,624,461 B2 12/2009 Tidwell et al.
7,788,752 B2 9/2010 Tidwell et al.
7,810,191 B2 11/2010 Littlehorn et al.
7,832,036 B2 11/2010 Littlehorn et al.
7,975,336 B1 * 7/2011 Perry ..... A47C 27/086 5/636
8,136,186 B1 3/2012 Leach
8,321,977 B1 12/2012 Kummerfeld et al.
8,321,978 B1 12/2012 Fulton
8,468,627 B2 6/2013 Leach
8,495,775 B2 7/2013 Fair et al.
8,516,638 B2 8/2013 Kummerfeld et al.
8,595,872 B2 12/2013 Tidwell
8,661,587 B1 * 3/2014 Leach ..... A47D 13/08 5/655
8,763,183 B2 7/2014 Tidwell
8,863,334 B2 10/2014 Gibbons et al.
8,950,029 B2 2/2015 Tidwell
9,021,635 B1 * 5/2015 Leach ..... A47C 20/02 5/632
9,113,719 B2 8/2015 Kummerfeld et al.
9,155,399 B1 10/2015 Zenoff
9,307,842 B2 4/2016 Gibbons
9,775,452 B2 10/2017 Gibbons et al.
9,776,098 B2 10/2017 Fair et al.
10,383,466 B2 * 8/2019 Wilmarth ..... A47C 20/025
10,561,259 B1 2/2020 Gaspari
10,898,007 B1 1/2021 Rozon
11,154,147 B2 10/2021 Adeeb, Jr.
11,607,052 B1 * 3/2023 Gallegos ..... A47G 9/0253
2005/0229316 A1 10/2005 Liao
2006/0031992 A1 * 2/2006 Moore ..... A47C 20/021 5/630
2007/0151031 A1 * 7/2007 Leach ..... A47C 20/021 5/632
2010/0175194 A1 * 7/2010 Mastrosimone-Gese ..... A47D 13/083 5/639
2014/0215719 A1 8/2014 Gibbons et al.
2015/0040320 A1 2/2015 Gibbons
2016/0037946 A1 2/2016 Melcher et al.
2017/0367507 A1 12/2017 Rakos
2021/0282565 A1 9/2021 Champ

FOREIGN PATENT DOCUMENTS

CN 206342268 U * 7/2017
CN 208598038 U * 3/2019
JP 3198304 U 6/2015

OTHER PUBLICATIONS

Leachco, "Back 'N Shape®" Product Specification from company website, Accessed on May 4, 2022, Retrieved from https://leachco.com/collections/leachco-catalog/products/back-n-shape 4 pages.
Leachco, "Boomerest®" Product Specification from company website, Accessed on May 4, 2022, Retrieved from https://leachco.com/collections/leachco-catalog/products/boomerest-sup-sup 4 pages.
Leachco, "Bump Bunchie®" Product Specification from company website, Accessed on May 4, 2022, Retrieved from https://leachco.com/collecitons/leachco-catalog/products/bump-bunchie 4 pages.
Leachco, "Driftwell®" Product Specification from company website, Accessed on May 4, 2022, Retrieved from https://leachco.com/collections/leachco-catalog/products/driftwell 4 pages.
Leachco, "Snoogle®" Product Specification from company website, Accessed on May 4, 2022, Retrieved from https://leachco.com/collections/leachco-catalog/products/snoogle 4 pages.
Leachco, "Snoogle® Bunchie®" Product Specification from company website, Accessed on May 4, 2022, Retrieved from https://leachco.com/collecitons/leachco-catalog/products/snoogle-bunchie 4 pages.
Leachco, "Snug 'N Hug®" Product Specification from company website, Accessed on May 4, 2022, Retrieved from https://leachco.com/collections/leachco-catalog/products/snug-n-hug 4 pages.
Pharmedoc, "Pregnancy Cooling Pillow" Product Specification from company website, Accessed on May 5, 2022 https://www.pharmedoc.com/products/u-shaped-pregnancy-pillow-with-cooling-cover 14 pages.
Queen Rose, "U-Shaped Pregancy Pillow" Product Specification from company website, Accessed on May 5, 2022, Retrieved from https://www.queenrose.com/collections/maternity-pillows/products/u-shaped-long-pregnancy-pillow-gray 4 pages.
AS Awesling, "Full Body Pillow" Product Specification from Amazon store. Accessed on May 5, 2022, Retrieved from https://www.amazon.com/stores/ASAWESLING主页/page/33B1B333-E-111-4F1C.B1DC-4F937F087379 7 pages.
Momcozy, "U Shaped Pregnancy Pillow" Product Specification from company website, Accessed on May 5, 2022, Retrieved from https://momcozy.com/products/momcozy-pregnancy-pillows 5 pages.
Boppy®, "Pregnancy Jersey Wedge" Product Specification from company website, Accessed on May 5, 2022, Retrieved from https://www.boppy.com/products/boppy-pregnancy-jersey-wedge 6 pages.
Boppy®, "Side Sleeper Pregnancy Pillow" Product Specification from company website, Accessed on May 5, 2022, Retrieved from https://www.boppy.com/products/boppy-side-sleeper-pregnancy-pillow 6 pages.

(56) References Cited

OTHER PUBLICATIONS

Boppy®, "Cuddle Pillow" Product Specification from company website, Accessed on May 5, 2022, Retrieved from https://www.boppy.com/products/boppy-cuddle-pillow 8 pages.
Boppy®, "Slipcovered Total Body Pregnancy Pillow" Product Specification from company website, Accessed on May 5, 2022, Retrieved from https://www.boppy.com/products/boppy-slipcovered-total-body-pregnancy-pillow 6 pages.

* cited by examiner

FULL BODY SIDE SLEEP PILLOW AND METHODS

CROSS REFERENCE TO RELATED APPLICATIONS

This application is a continuation of U.S. Non-Provisional patent application Ser. No. 17/726,221, filed on Apr. 21, 2022, which is incorporated by reference for all purposes.

BACKGROUND OF THE INVENTION

The embodiments relate generally to the field of pillows and, in particular, to pillows that may be used to support various parts of the body.

Pillows exist in a variety of shapes and sizes. Perhaps the most common type of pillow is generally rectangular and is filled with natural or synthetic materials. Such pillows are traditionally designed to support a person's head while lying in bed. Another type of pillow is generally curved and has an interior well region. Such pillows have found use in supporting babies, when nursing, when sitting, and the like. Such pillows are described in U.S. Pat. Nos. 5,261,134; 5,661,861; 6,038,720; 6,055,687; 6,685,024; 6,434,770; 6,671,908; 6,532,612; 6,279,185; and 6,412,128, the complete disclosures of which are herein incorporated by reference.

A further type of pillow is a body support pillow that supports multiple parts of the body. An example of such a pillow is described in U.S. Pat. No. 7,810,191, the complete disclosure of which is herein incorporated by reference.

BRIEF SUMMARY OF THE INVENTION

The embodiments described herein are generally directed to body pillows and methods of use. In a first embodiment, a pillow system includes an elongate pillow body that includes fill material and a fabric shell surrounding the fill material. The pillow body has an outer periphery and an inner periphery and includes or defines an upper section, a lower section, and a central section that is disposed between the upper section and the lower section. The upper section is configured to support a first portion of a user's body and the lower section is configured to support a second portion of the user's body. The pillow system also includes a pocket that is configured to hold a torso pillow and an elongate material band that operably couples the pocket with the pillow body so that the pocket is extendable from the inner periphery of the pillow body. The pocket is extendable from the pillow body, via the elongate material band, to position the torso pillow distally of the pillow body and enable the user to lay atop the material band with the torso pillow and pillow body positioned on opposite sides of the user's body.

The pillow system also includes a slipcover that is positionable over the pillow body. The slipcover includes an upper portion, a central portion, and a lower portion that correspond in shape and size with the upper section, the central section, and the lower section of the pillow body. The slipcover includes an opening on an outer periphery that allows the pillow body to be inserted into and removed from an interior of the slipcover. The slipcover may be constructed of a first material and the material band may be constructed of a second material that is different than the first material. The second material may be an elastic material that allows a distance of the pocket from the pillow body to be varied to accommodate a shape and size of the user. The pocket may also be constructed of the second material to enable the torso pillow to be replaced with a different shaped and/or sized torso pillow.

The slipcover may also include a narrowed neck between the central portion and the upper portion. A proximal end of the material band may be connected to the narrowed neck of the slipcover. The slipcover may further include a second narrowed neck between the central section and the lower section of the slipcover. The material band may define a channel between the pocket and the opening of the slipcover. In such instances, the torso pillow may be insertable through the channel of the material band into the pocket.

The pillow body may include a first inner wall that segments the upper section and the central section of the inner pillow and a second inner wall that segments the central section and the lower section of the inner pillow. The first inner wall and the second inner wall may prevent the fill material from migrating between the upper section, the central section, and the lower section of the pillow body. The first inner wall may have a diameter that is less than a diameter of the upper section and less than a diameter of the central section. In such instances, the pillow body may be narrowed, or have a narrowed neck at the first inner wall. Similarly, the second inner wall may have a diameter that is less than a diameter of the lower section and less than the diameter of the central section. In such instances, the pillow body may be narrowed, or have a narrowed neck, at the second inner wall.

In a second embodiment, a pillow system includes a body pillow, a torso body, and a slipcover. The body pillow includes fill material and a fabric shell surrounding the fill material. The torso pillow also includes fill material and a fabric shell surrounding the fill material. The slipcover is positionable over the body pillow and the torso pillow to enclose the body pillow and torso pillow within the slipcover. The slipcover has or defines an outer periphery and an inner periphery and includes an upper portion, a lower portion, a central portion disposed between the upper portion and the lower portion, a pocket, and an elongate material band that operably connects the pocket with the central portion of the slipcover. The upper portion, lower portion, and central portion are configured to enclose the body pillow while the pocket is configured to enclose the torso pillow. The elongate material band connects the pocket with the central portion so that the pocket is extendable from the inner periphery of the slipcover to position the torso pillow distally of the body pillow and thereby enable a user to lay atop the material band with the torso pillow and body pillow positioned on opposite sides of a body of the user.

The upper portion, lower portion, and central portion of the slipcover may be constructed of a first material and the material band may be constructed of a second material that is different than the first material. The second material may be an elastic material that allows a distance of the pocket to be varied in relation to the inner periphery of the slipcover. The slipcover may include or define a narrowed neck that is positioned between the central portion and the upper portion. A proximal end of the material band may be connected to the narrowed neck of the slipcover. The slipcover may include an opening on the outer periphery that allows the body pillow to be removed from the slipcover. The material band may include or define a channel between the pocket and the opening. The torso pillow may be insertable through the channel of the material band into the pocket.

The body pillow may include a first inner wall that segments an upper section and a central section of the body pillow and/or a second inner wall that segments the central section and a lower section of the body pillow. The first inner wall and/or the second inner wall may prevent the fill material from migrating between the upper section, central section, and lower section of the body pillow. The first inner wall may have a diameter that is less than a diameter of the upper section and less than a diameter of the central section. In such instances, the body pillow may be narrowed, or define a narrowed neck, at the first inner wall. Similarly, the second inner wall may have a diameter that is less than a diameter of the lower section and less than the diameter of the central section. In such instances, the body pillow may be narrowed, or define a narrowed neck, at the second inner wall.

In a third embodiment, a method of forming a pillow includes providing a body pillow, a torso pillow, and a slipcover. The body pillow and torso pillow each have fill material and a fabric shell surrounding the fill material. The slipcover has or defines an outer periphery and an inner periphery and includes an upper portion, a lower portion, a central portion disposed between the upper portion and the lower portion, a pocket, and an elongate material band that operably connects the pocket with the central portion of the slipcover. The method also includes inserting the torso pillow into the pocket so that the torso pillow is enclosed within the pocket and inserting the body pillow within the slipcover so that the body pillow is enclosed within the upper portion, the lower portion, and the central portion of the slipcover. The pocket is extendable from the inner periphery of the slipcover to position the torso pillow distally of the body pillow and thereby enable a user to lay atop the material band with the torso pillow and body pillow positioned on opposite sides of a body of the user.

The upper portion, lower portion, and central portion of the slipcover may be constructed of a first material and the material band may be constructed of a second material that is different than the first material. The second material may be an elastic material that allows a distance of the pocket to be varied in relation to the inner periphery of the slipcover. The slipcover may include or define a narrowed neck between the central portion and the upper portion. A proximal end of the material band may be connected to the narrowed neck of the slipcover. The body pillow may include a first inner wall that segments an upper section and a central section of the body pillow to prevent the fill material from migrating between the upper section and the central section of the body pillow and a second inner wall that segments the central section and a lower section of the body pillow to prevent the fill material from migrating between the central section and the lower section of the body pillow.

DETAILED DESCRIPTION OF THE INVENTION

Figure 1:
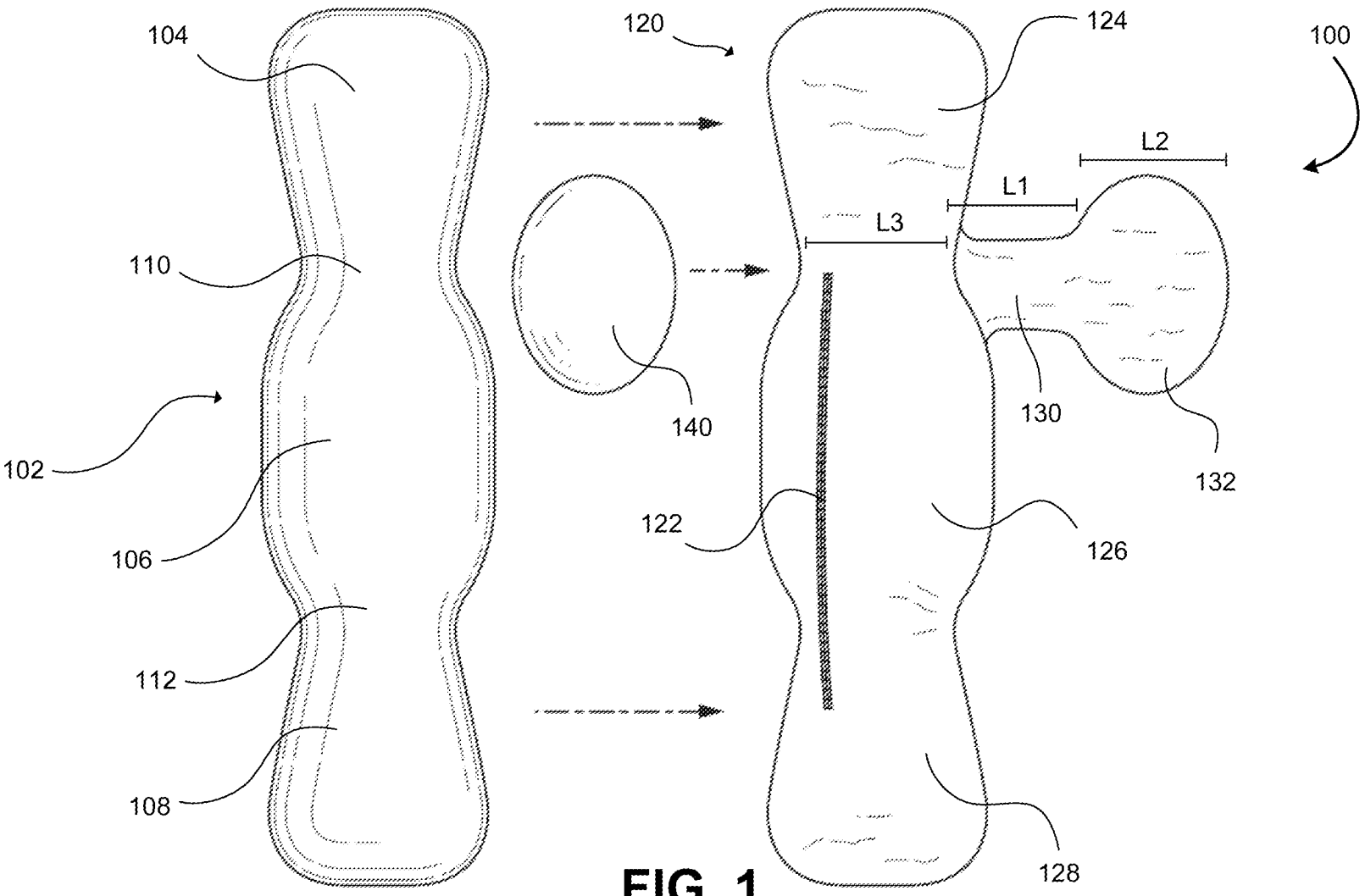
FIG. 1 is a perspective view of an embodiment of a multi-pillow support system.

Embodiments disclosed generally relate to body pillows and methods of use. In a first embodiment, a multi-pillow support system (hereinafter pillow system) includes an elongate pillow body, or body pillow, having an upper portion, lower portion, and central portion that is positioned between the upper and lower portions. The upper portion, lower portion, and central portion are configured to support and cushion different regions or areas of a user's body. The pillow body has, or defines, an outer periphery and an inner periphery. The pillow system also includes a pocket and an elongate material band, strip, or bridge that couples the pocket with the pillow body. The pocket is configured to hold a torso pillow that is a separate pillow from the elongate pillow body. In some instances, however, the pocket and/or elongate material band, strip, or bridge may be integrated into the elongate pillow body so that all the components form or define a single connected pillow.

The elongate material band, strip, or bridge operably connects the pocket with the pillow body so that the pocket is extendable from the inner periphery of the pillow body. When the pocket is extended from the inner periphery of the pillow body, the torso pillow is positioned distally of the central portion of the pillow body, which enables a user to lay atop the material band, strip, or bridge with the torso pillow and elongate pillow body positioned on opposite sides of the user's body.

The elongate pillow body includes fill material and a fabric shell that surrounds the fill material. In some instances, the pillow system includes a slipcover, or simply cover, having a main chamber that encases the elongate pillow body. The pocket and material band, strip, or bridge may be attached or integrally connected with the slipcover. The slipcover includes an opening on an outer periphery that allows the inner pillow to be inserted into and removed from an interior of the slipcover. In some instances, the torso pillow may also be inserted into and removed through the opening of the slipcover. The pocket and material band, strip, or bridge can be stowed in the main chamber of the slipcover when not in use. The slipcover is configured to be removed from the pillow body and torso pills (e.g., for washing and/or for changing colors/style of the multi-pillow support system).

The multi-pillow support system can be used by most anyone, but, in some embodiments, is more particularly designed for a woman who is pregnant. For example, a woman who is pregnant may rest her head and/or legs on the body pillow while the abdomen (e.g., enlarged due to pregnancy) is rested on the torso pillow. The body pillow and torso pillow are connected, via the material band or bridge, in a manner that enables the woman to easily lay atop the respective pillows. For example, the woman may lay atop the material band or bridge so that torso pillow and body pillow are positioned on opposite sides of the woman's body.

Having described various aspects of the embodiments generally, additional features, aspects, and configurations, and uses of the pillow system, will be apparent from the disclosure of the various figures provided herein below.

Referring to FIGS. 1-5B, illustrated is an embodiment of a pillow system 100. The pillow system 100 includes a body pillow 102, a torso pillow 140, and a slipcover 120 that is positionable over the body pillow 102 and torso pillow 140. The body pillow 102 and the torso pillow 140 each include fill material 150 and a fabric shell or covering that surround and encase the fill material 150. The body pillow 102 is substantially larger than the torso pillow 140 and is designed to support and cushion a body of the user. The torso pillow 140 is designed to be positioned on an opposite side of the user's body and is likewise designed to support and cushion a portion of the user's body. In some instances, the torso pillow 140 may support and cushion a woman's abdomen, which may be particularly useful during pregnancy. However, as illustrated in FIGS. 6-10, the body pillow 102 and the torso pillow 140 may be arranged in various configurations to support different areas of the user's body. Similarly, each of these pillows, or one or the pillows in isolation, may be used to support and cushion any individual, including non-pregnant individuals, as desired.

The body pillow 102 has a longitudinal length that is substantially greater than the torso pillow 140. A width of the body pillow 102 may also be greater than a width of the torso pillow 140. In some instances, a thickness of both pillows, 102 & 140, may be similar. For example, the thickness of the torso pillow 140 may be between 0.8 and 1.2 times a thickness of the body pillow 102. In other instances, the thickness of the torso pillow 140 may be between 0.9 and 1.1 times the thickness of the body pillow 102. A similar thickness of the two pillows, 102 & 140, may aid in supporting the opposing sides of the user's body and help maintain the user in a side sleeping position.

Figure 5A:
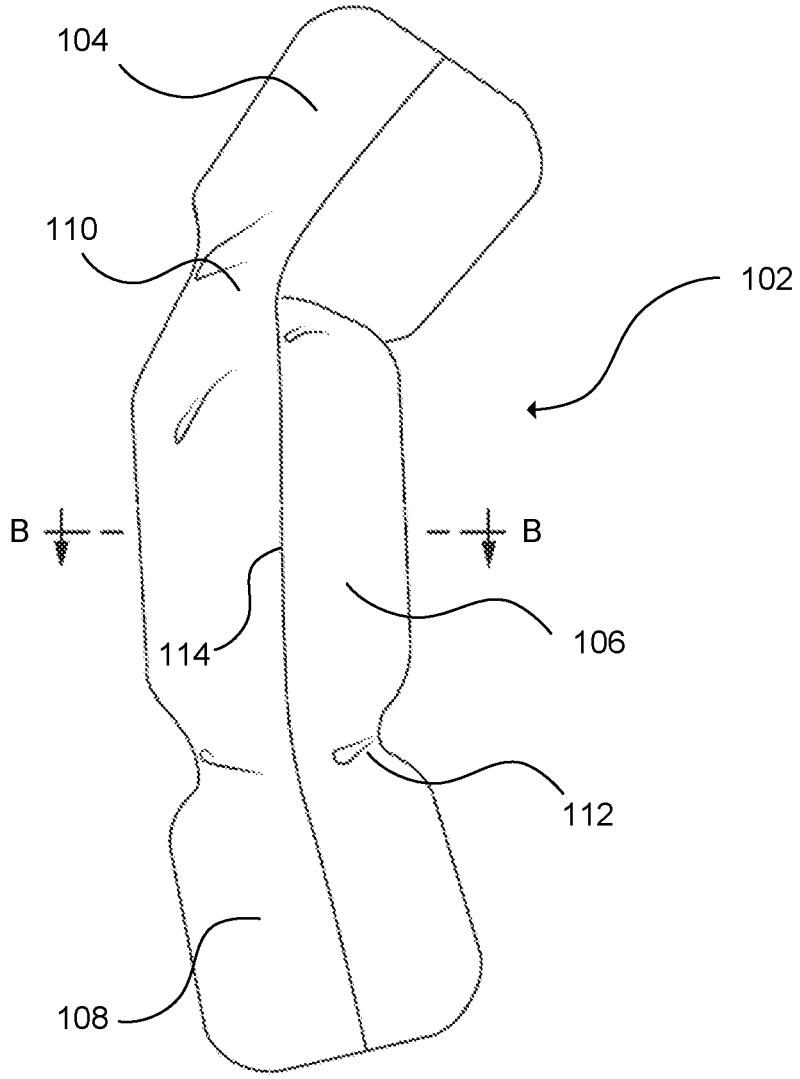
FIG. 5A is a top view of a body pillow of the multi-pillow support system of FIG. 1.

As illustrated in FIG. 5A, the body pillow 102 includes an upper section 104, a central section 106, and a lower section 108. In some instances, the central section 106 has a longitudinal length that is greater than a longitudinal length of the upper section 104 and greater than a longitudinal length of the lower section 108. Stated differently, the central section 106 may be longer than the upper section 104 and the lower section 108, which may be beneficial for supporting the abdomen and/or back of the user. A width and/or thickness of the upper section 104, central section 106, and lower section 108 may be substantially the same. An amount or density of fill material 150 that is used in each section may also be substantially the same. In such instances, the only variation between the upper section 104, central section 106, and lower section 108 may be the greater length of the central section 106.

The upper section 104, central section 106, and lower section 108 may be positioned about the body to support various areas of the body, including the head, neck, shoulders, back, abdomen, hips, upper legs, knees, lower legs, etc. Various orientations and uses of the pillow system 100 are illustrated in FIGS. 6-10. It should be realized that various other orientations and uses of the pillow system 100 may also be employed to cushion and support desired areas of the body.

The body pillow 102 narrows, or has a narrowed neck (hereinafter upper neck 110), between the upper section 104 and the central section 106. The narrowed upper neck 110 between the upper section 104 and the central section 106 facilitates in articulation or pivoting of the upper section 104 in relation to the central section 106. Articulation of the upper section 104 allows the shape and/or orientation of the upper section 104 to be modified to provide a desired support and cushioning of the body. Similarly, the body pillow 102 narrows, or has a narrowed neck (hereinafter lower neck 112), between the central section 106 and the lower section 108. The narrowed lower neck 112 facilitates in articulation or pivoting of the lower section 108 in relation to the central section 106, which allows the shape and/or orientation of the lower section 108 to be modified to a greater degree to support and cushion the body. The articulating upper and lower portions, 104 & 108, may provide support to the hips, knees, and ankles regardless of whether the knees are bent or straight. The articulating upper and lower portions, 104 & 108, allow the body pillow 102 to easily move with the legs. In some instances, a width of the upper neck 110 and the lower neck 112 may be substantially the same. As such, the body pillow 102 may be symmetrical about a plane that is positioned centrally along the pillow's longitudinal length and that is orthogonal to the longitudinal direction. The symmetrical shape of the body pillow 102 enables the pillow to be easily inserted into the slipcover 120 without requiring a specific orientation. In some instances, the body pillow 102 may include either the upper neck 110 or the lower neck 112, but not both necks.

In some instances, the body pillow 102 includes a contouring seam 114 that also facilitates in articulation of the upper section 104 and/or lower section 108. The contouring seam 114 may be positioned on an upper and/or lower surface of the body pillow 102 between opposing peripheral sides. The contouring seam 114 may allow the body pillow 102 to flex to a greater degree by providing a greater degree of flexing, stretching, or bending of the upper or lower surface of the body pillow 102. The contouring seam 114 enables the body pillow 102 to bend with the user.

Figure 5B:
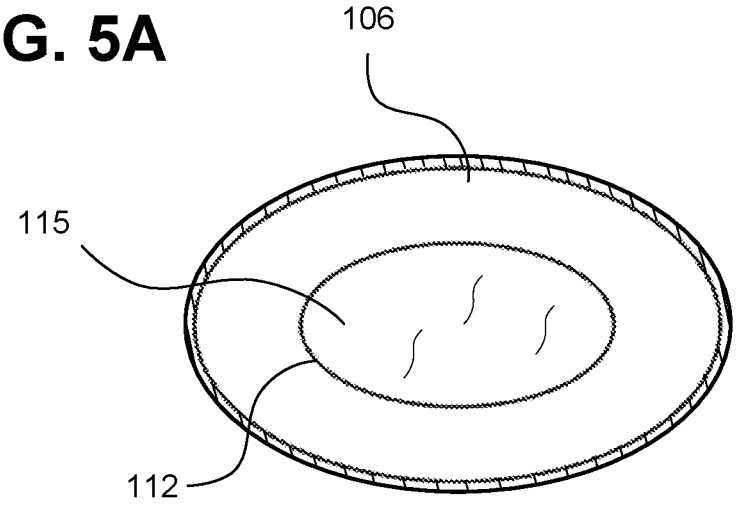
FIG. 5B is a cross section view of the body pillow of FIG. 5A.

The two necks, 110 & 112, of the body pillow 102 are formed by inner walls 115 that segment or divide the upper section 104, central section 106, and lower section 108 into separate sections. FIG. 5B illustrates a cross section view of the body pillow 102 taken along the line marked B-B in FIG. 5A, in which the fill material 150 has been removed and the inner wall 115 between the central section 106 and lower section 108 is visible. The inner wall 115 segments or divides the body pillow 102 into the central section 106 and lower section 108. The inner wall 115 has a diameter (or width) that is less than a diameter (or width) of the central and lower sections, 106 & 108. The inner wall 115 is attached to the inner periphery of the body pillow 102, which causes the body pillow 102 to narrow towards the inner wall 115, thereby forming the lower neck 112. The inner wall 115 may be attached to the inner peripheral wall of the body pillow 102 using any means including stitching, adhesive bonding, mechanical fastening, and the like. A similar inner wall is positioned between the upper section 104 and central section 106 and segments or divides the body pillow into these two sections, 104 and 106.

The inner wall 115 forms a continuous wall or barrier that spans the interior of the body pillow 102 and the lower neck 112. Stated differently, the inner wall 115 does not include any openings, apertures, or gaps, either along the inner periphery of the lower neck 112 or along the material section that spans the interior of the body pillow 102. In this manner, the inner wall 115 prevents the fill material 150 from migrating between the central section 106 and lower section 108, which maintains an even distribution of the fill material 150 in these sections of the body pillow 102. The inner wall 115 may also aid in articulation of the lower section 108 in relation to the central section 106. In other instances, the inner wall 115 may include one or more openings or gaps, which may be shaped and sized to enable some migration of the fill material 150 or to prevent migration of the fill material 150 despite the openings or gaps. The inner wall 115 that is positioned at the upper neck 110 to segment the upper and central portions, 104 & 106, may have a similar configuration and function to that illustrated in FIG. 5B. In a specific embodiment, the body pillow 102 may be made with a woven cotton polyester blend and the slipcover 120 may be constructed, or consist of, a woven fabric for the portion of the slipcover 120 that covers the body pillow 102 and a stretch knit construction for the portion of the slipcover 120 that covers the torso pillow 140. The woven fabric may comprise, or consist of 100% cotton, a cotton polyester blend, a rayon blend, and the like.

The torso pillow 140 may be spherical in shape as illustrated in FIG. 1. Other shapes of the torso pillow 140 may also be employed, including rectangular, oval, hemispherical, and the like. The torso pillow 140 is commonly separate from the body pillow 102, but it may be connected to the body pillow in some instances. The use of a separate torso pillow 140 allows the torso pillow to be completely removed from the pillow system 100, which allows the body pillow 102 and slipcover 120 to be used in isolation. For example, the torso pillow 140 may be removed and used to cushion and support the user's head and neck while the pillow system 100 is used to cushion and support the body.

When positioned over the body pillow 102 and torso pillow 140, the slipcover 120 encloses the body pillow 102 and torso pillow 140 within an interior of the slipcover 120. The slipcover 120 has an outer periphery and an inner periphery that is designed to face the user. The slipcover 120 also includes an upper portion 124, a lower portion 128, and a central portion 126 that is disposed between the upper portion 124 and the lower portion 128. The upper portion 124, central portion 126, and lower portion 128 are configured to be positioned over and enclose the body pillow 102. The slipcover 120 includes an opening 122 on the outer peripheral side that allows the body pillow 102 to be inserted into the interior of the slipcover 120 and removed therefrom.

Figure 2:
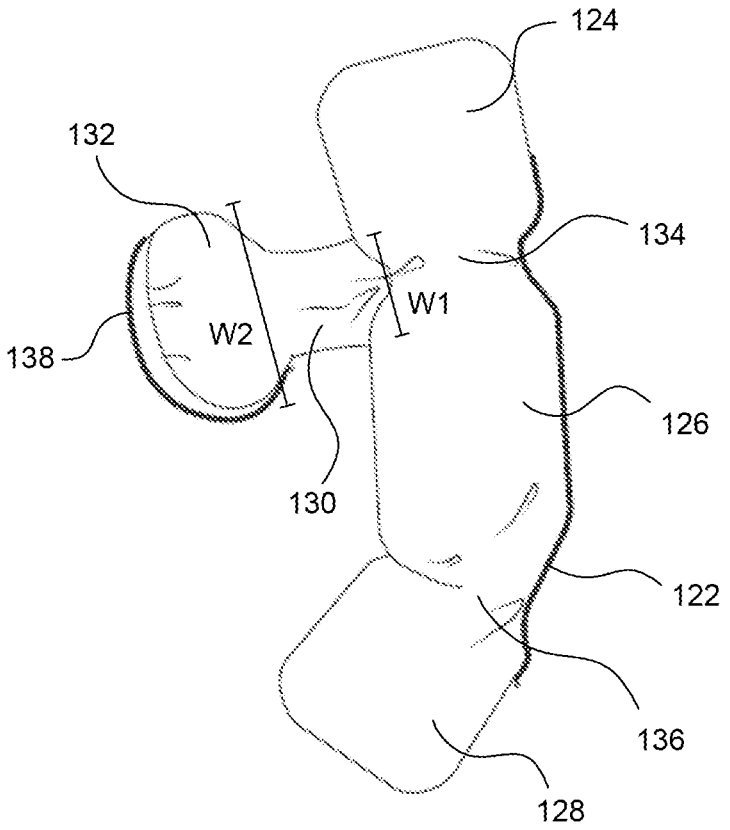
FIG. 2 is a perspective view of the multi-pillow support system of FIG. 1 with a body pillow and torso pillow inserted within a slipcover.

The upper portion 124 of the slipcover 120 corresponds in shape and size to the upper section 104 of the body pillow 102. Similarly, the central and lower portions, 126 & 128, of the slipcover 120 correspond in shape and size to the central and lower sections, 106 & 108, of the body pillow 102. As illustrated in FIG. 2, the slipcover 120 also includes an upper narrowed neck 134 that is positioned between the upper portion 124 and the central portion 126 and a lower narrowed neck 136 that is positioned between the central portion 126 and the lower portion 128. In some instances, the slipcover 120 may include either the upper narrowed neck 134 or the lower narrowed neck 136, dependent on whether the body pillow 102 includes one or two necks. Unlike the upper and lower necks, 110 & 112, of the body pillow 102, the upper and lower narrowed necks, 134 & 136, of the slipcover 120 do not include inner walls that segment or divide the upper, central, and lower portions of the slipcover 120. Rather, the upper, central, and lower portions of the slipcover 120 form one continuous opening along the longitudinal length of the slipcover 120. The opening 122 on the outer peripheral side of the slipcover 120 may span an entire length of the central portion 126 and extend partially along the upper portion 124 and/or lower portion 128. The opening 122 may also extend along the outer periphery of the upper and lower narrowed necks, 134 &136.

The shape and size of the upper and lower narrowed necks, 134 & 136, corresponds in shape and size to the upper and lower necks, 110 & 112, of the body pillow, respectively. Because the slipcover 120 corresponds in shape and size to the body pillow 102, the pillow system 100 may look substantially similar regardless of whether the slipcover 120 is positioned over the body pillow 102.

The slipcover 120 also includes a pocket 132 that is configured to enclose the torso pillow. The pocket 132 is typically shaped and sized to correspond with the shape and size of the torso pillow 140. For example, the pocket 132 may have a roughly circular or spherical shape, which may correspond to a shape of the torso pillow 140. The pocket 132 may be may of an elastic material that may allow torso pillows 140 of different shapes and sizes to be inserted within the pocket 132. For example, a roughly spherical toros pillow 140 may be removed from the pocket 132 and an oval shaped or squarer shaped torso pillow may be inserted within the pocket 132. The elastic material of the pocket 132 allows the pocket 132 to stretch over the larger or different shaped torso pillow 140 without overly compressing the pillow 140. The elastic material of the pocket 132 may include polyester, lycra, or a combination thereof. The weave of the pocket's fabric material may also aid in stretching or expansion of the pocket 132.

The pocket 132 is operably connected to a main body of the slipcover 120 via an elongate material band, strip, or bridge 130 (hereinafter material band 130). The material band 130 connects the pocket 132 to the slipcover's main body in a manner that enables the pocket 132 to be extended distally from the inner periphery of the slipcover 120. Extension of the pocket 132 distally from the inner periphery of the slipcover positions the torso pillow 140 distally of the body pillow 102, which enables the user to lay atop the material band 130 with the torso pillow 140 and body pillow 102 positioned on opposite sides of the user's body. Embodiments of this positioning of the torso pillow 140 and body pillow 102 are illustrated in FIGS. 6-10.

Because the material band 130 is attached to both the pocket 132 and the slipcover 120, a position of the torso pillow 140 in relation to the body pillow 102 is maintained while the user sleeps or rests. Stated differently, the torso pillow 140 does not move away from the body pillow 102 while the user sleeps or rests because the material band 130 attaches the pocket 132 to the slipcover 120. Maintaining the position of the torso pillow 140 and body pillow 102 helps the user remain in a comfortable, sleep-inducing position, such as on their side, during sleep. Maintaining the position of the pillows also helps ensure that the desired areas of the body, such as an enlarged abdomen due to pregnancy, remain supported during sleep or rest periods.

Figure 3:
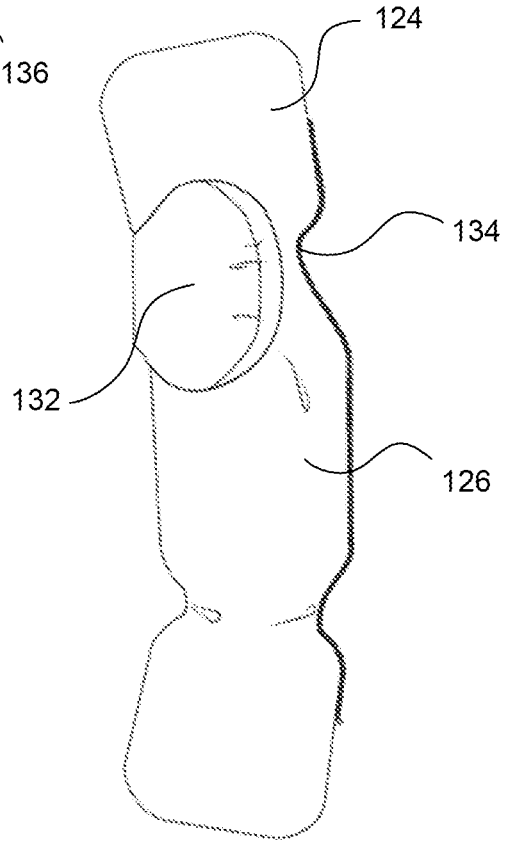
FIG. 3 is a perspective view of the multi-pillow support system of FIG. 1 with toros pillow folded over a narrowed neck of the slipcover.

The material band 130 may be made of an elastic material that allows a distance of the pocket 132 to be varied in relation to the inner periphery of the slipcover 120. For example, the elastic material of the material band 130 allows the pocket 132 to be stretched outward from the inner periphery of the slipcover 120 to accommodate users of different shape and size. In some embodiments, the material band 130 may be made of polyester, lycra, or a combination thereof. The material band 130 and pocket 132 may be made of the same material while the upper portion 124, lower portion 128, and central portion 126 of the slipcover 120 are made of a different, and typically less elastic, material. In some instances, a color of the upper portion 124, lower portion 128, and central portion 126 of the slipcover 120 may differ than a color of the material band 130 and pocket 132. The different colors may provide a decorative aesthetic look that is attractive to users. The different colors may result in the pocket 132 appearing as a decorative throw pillow when the pillow system 100 is positioned on a bed. FIG. 3 illustrates the pocket 132 tucked against the main body of the slipcover 120 to provide the decorative throw pillow look.

In some embodiments, a proximal end of the material band 130 is connected to the upper narrowed neck 134 of the slipcover 120. The proximal end of the material band 130 may span the upper narrowed neck 134 so that opposing sides or edges of the material band 130 are connected to the upper portion 124 and/or central portion 126. Coupling the proximal end of the material band 130 to the upper narrowed neck 134 enables the pocket 132 to be folded over and positioned in the recessed portion of the upper narrowed neck 134 as illustrated in FIG. 3. The attachment of the proximal end of the material band 130 to the upper narrowed neck 134 also strategically positions the torso pillow 140 in areas of the body that may need added support and cushioning.

The material band 130 has a width W1 that is less than a width W2 of the pocket 132. As such, the material band 130 is narrower than the pocket 132 and the torso pillow 140 that is inserted within the pocket 132. In some embodiments, the width W1 of the material band 130 may be between 20 and 70 percent of the width W2 of the pocket 132. The width W1 of the material band 130 is more commonly between 30 and 60 percent of the width W2 of the pocket 132, and in specific instances may be between 35 and 55 percent of the width W2 of the pocket 132. In some embodiments, the width W1 of the material band 130 may be less than 50 percent of the width W1 of the pocket 132 and is typically more than 25 percent of the width W1. In some embodiments, a length L1 of the material band 130 may correspond with the width W2 of the pocket 132. For example, the length L1 of the material band 130 may be between 75 and 125 percent of the width W2 of the pocket 132, and more commonly between 85 and 115 percent of the width W2. In specific instances, the length L1 of the material band 130 may be between 90 or 95 percent and 110 or 105 percent of the width W2 of the pocket 132. In other embodiments, the length L1 of the material band 130 may between within 10 to 20 percent of the width W1 of the material band 130 and/or within 10 to 20 percent of a length of the pocket 132.

The length L1 of the material band 130 is typically greater than a length L3 of the upper narrowed neck 134 as measured between the narrowest point of the inner and outer peripheral sides of the slipcover 120. The length L1 of the material band 130 may also be greater than a length L2 of the pocket 132. The length L3 of the upper narrowed neck 134 may be between 60 and 90 percent of the length L1 of the material band 130, and more commonly between 70 and 90 percent, or 70 and 80 percent of the length L1 of the material band 130. Similarly, the length L2 of the pocket may be between 60 and 100 percent of the length L1 of the material band 130, and more commonly between 70 and 90 percent, or 70 and 80 percent of the length L1 of the material band 130. The length L1 of the material band 130 may be measured from the narrowest point of the upper narrowed neck 134 and the transition between the material band 130 and the pocket 132 where the material substantially widens. The length L1 of the material band 130 is typically at least as wide as a width of user's body, which enables the user to lay atop the material band 130 without laying on the fill material 150 of the body pillow 102 or torso pillow 140 in a manner that would cause discomfort. The elasticity of the material band 130 allows a user to increase the length L1 of the material band 130 to ensure that the user is not laying atop the fill material 150 of the body pillow 102 or torso pillow 140 in a manner that would cause discomfort. In a specific embodiment, the length L1 of the material band 130 may be between 8 and 18 inches, and more commonly between 10 and 16 inches.

Figure 4A:
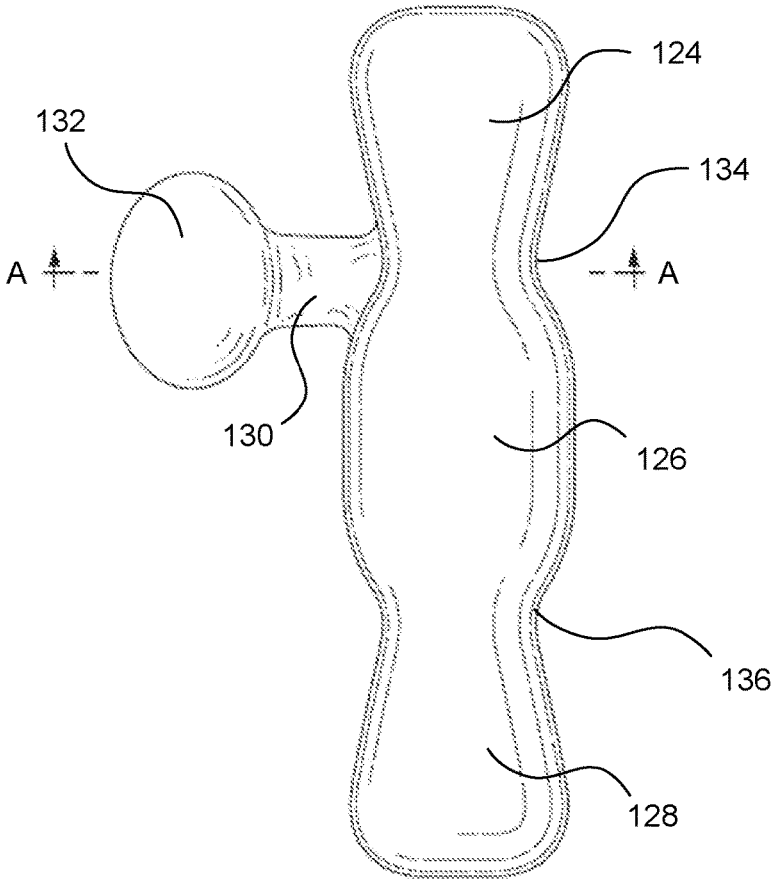
FIG. 4A is a top view of the multi-pillow support system of FIG. 1.
Figure 4B:
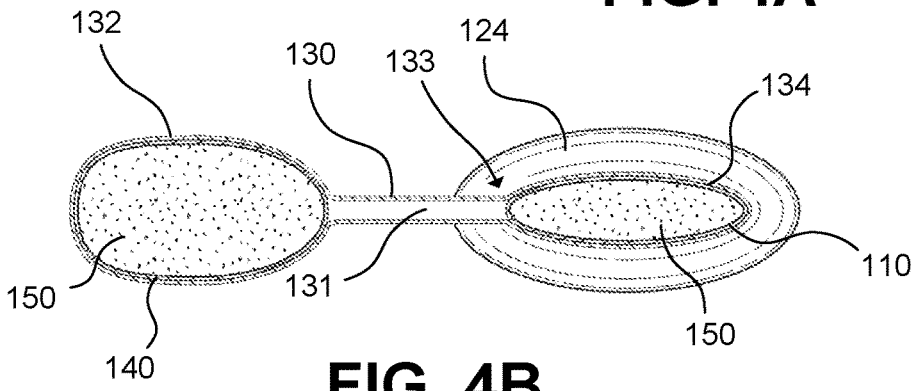
FIGS. 4B-C are cross section views of the multi-pillow support system of FIG. 1 showing various orientations of a torso pillow, body pillow, and slipcover.
Figure 4C:
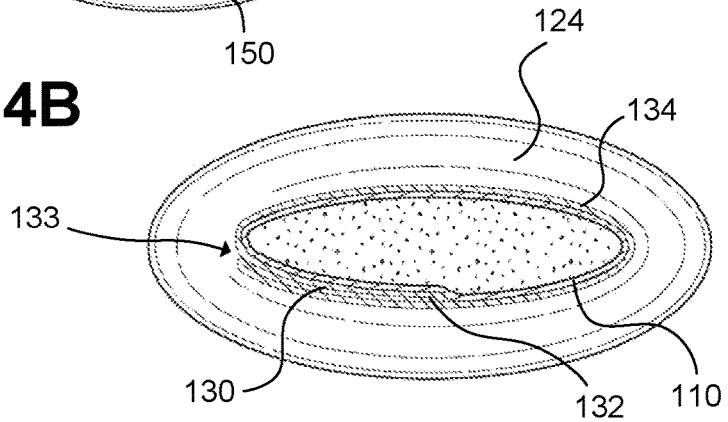

FIG. 4B illustrates a cross section of the slipcover 120, which shows the body pillow 102 inserted within the slipcover 120 and the torso pillow 140 inserted within the pocket 132. The cross section is taken along the line marked A-A in FIG. 4A and along the upper narrowed neck 134 of the slipcover 120 and the material band 130 and pocket 132. FIG. 4B illustrates the upper neck 110 of the body pillow 102 positioned within the upper narrowed neck 134 of the slipcover 120. FIG. 4B also illustrates an opening 133 at the intersection of the upper narrowed neck 134 and the material band 130. As illustrated in FIG. 4C, the opening allows the material band 130 and pocket 132 to be inserted and stowed within the interior of the slipcover 120 when the torso pillow 140 is not used. In such instances, the body pillow 102 and slipcover 120 may be used in isolation to support and cushion the user's body.

The material band 130 and pocket 132 may be positioned atop or underneath the body pillow 102 when inserted within the opening 133 of the slipcover 120. In some instances, the opening 133 may include a closure mechanism, such as hook and loop fasteners, magnetic components, mechanical fasteners, and the like, that enable the opening 133 to be closed after the material band 130 and pocket 132 are inserted within the opening 133. The elastic material of the material band 130 and pocket 132 results in the material band 130 and pocket 132 occupying a small space or volume within the interior of the slipcover 120.

When extended from the opening 133, the material band 130 defines a channel 131 between the pocket 132 and the opening 133. The channel 131 is configured so that the torso pillow is insertable through the channel 131 and into the pocket 132. To insert the torso pillow 140 through the channel 131, the torso pillow 140 is inserted through the opening 122 in the slipcover 120 and into the channel 131. The elastic material of the material band 130 allows the material band 130 to expand as the torso pillow 140 is inserted through the channel 131 and into the pocket 132. The elastic material is sufficiently flexible so that the width W1 of the material band 130 can expand to near the width W2 of the pocket 132, which enables the torso pillow 140 to be easily inserted through the channel 131 and into the pocket 132. The channel 131 typically does not include any fill material 150. Rather, the channel 131 is hollow or devoid of any material within its interior, which enables the torso pillow 140 to be easily inserted through the channel 131.

In some embodiments, a distal edge of the pocket 132 may include an opening 138 that allows the torso pillow 140 to be inserted into the pocket 132, and removed therefrom, through the pocket's distal edge. In such embodiments, the material band 130 may not include a channel 131. Rather, the material band 130 may be solid or continuous fabric material that extends between the opening 133 and the pocket 132. In such instances, the torso pillow 140 may only be inserted into the pocket 132 through the opening 138 in the pocket 132. In other embodiments, the material band 130 may include a channel 131 and the pocket 132 may include an opening 138. In such instances, the torso pillow may be inserted through the channel 131 of the material band 130 or through the opening 138 in the pocket 132.

Figure 6:
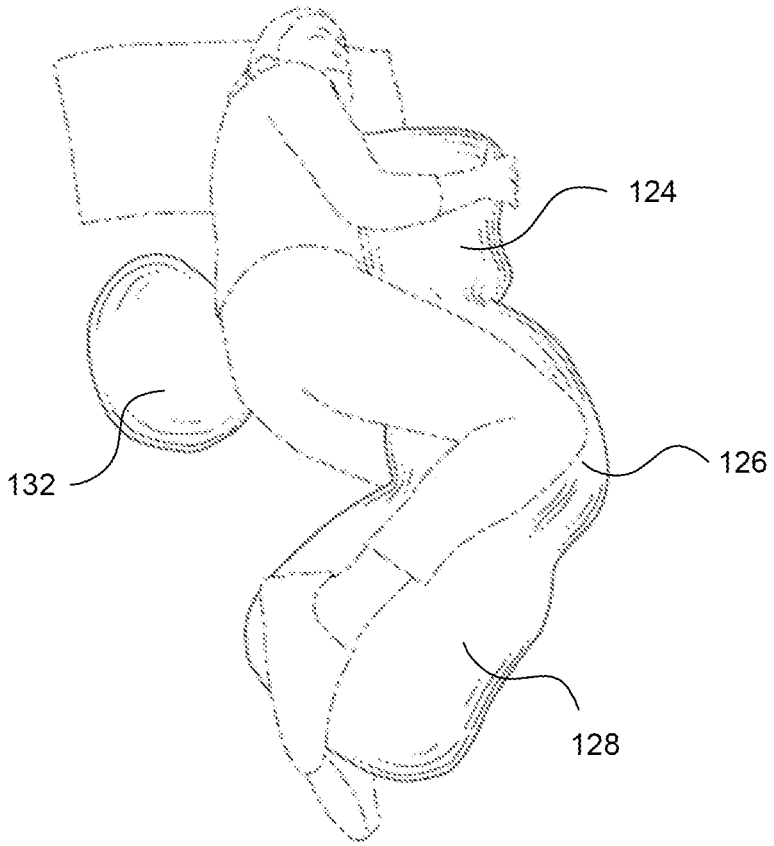
FIGS. 6-10 illustrate various uses of the multi-pillow support system of FIG. 1.

FIGS. 6-10 illustrate non-limiting uses of the pillow system 100. In FIG. 6, a user is lying atop the pillow system 100 facing the inner periphery of the slipcover 120. The user is lying atop the material band 130 with the pocket 132 and torso pillow 140 positioned adjacent the lower back and the upper portion 124 positioned against or adjacent the user's chest. The central portion 126 of the slipcover 120 is positioned between the user's knees and the lower portion 128 is positioned between the legs. The user's head is positioned on a separate pillow.

Figure 7:
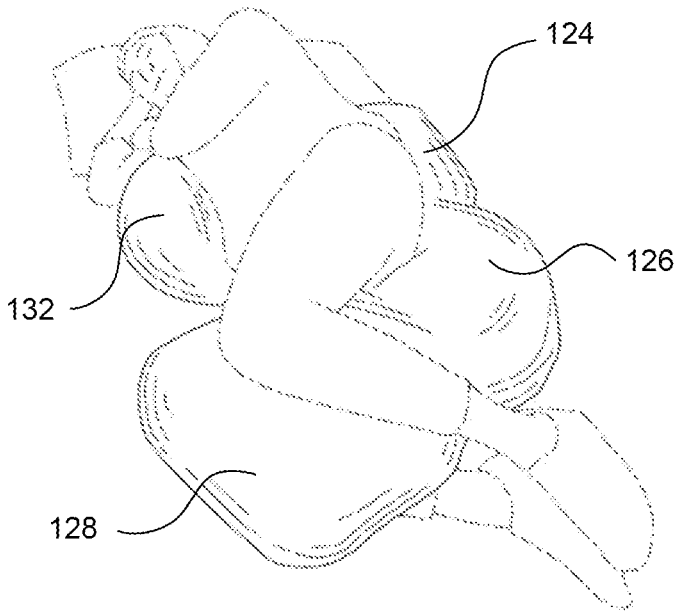

In FIG. 7, the user is lying atop the pillow system 100 facing the pocket 132. The user is lying atop the material band 130 with the pocket 132 and torso pillow 140 positioned adjacent the user's chest. The upper portion 124 of the slipcover 120 is positioned against or adjacent the user's back while the central portion 126 is positioned about the back of the upper leg and the lower portion 128 is positioned between the legs. The user's head is positioned on a separate pillow.

Figure 8:
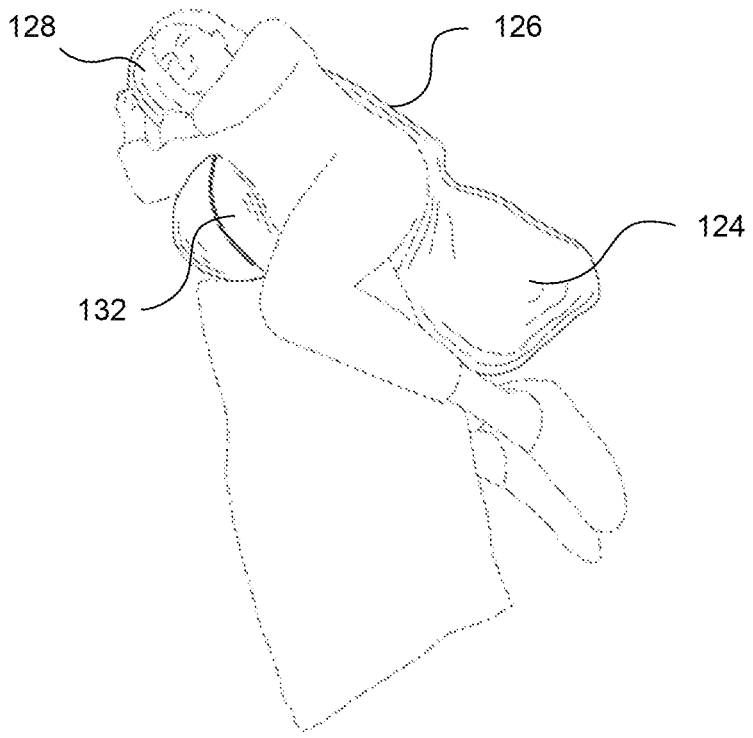

In FIG. 8, the user is lying atop the pillow system 100 facing the pocket 132. The user is lying atop the material band 130 with the pocket 132 and torso pillow 140 positioned adjacent the user's chest. The lower portion 128 is positioned under the user's head and the central portion 126 is positioned against the user's back. The upper portion 124 may be positioned below the user's back or between the upper legs. A separate pillow may be positioned between the user's knees and/or legs.

Figure 9:
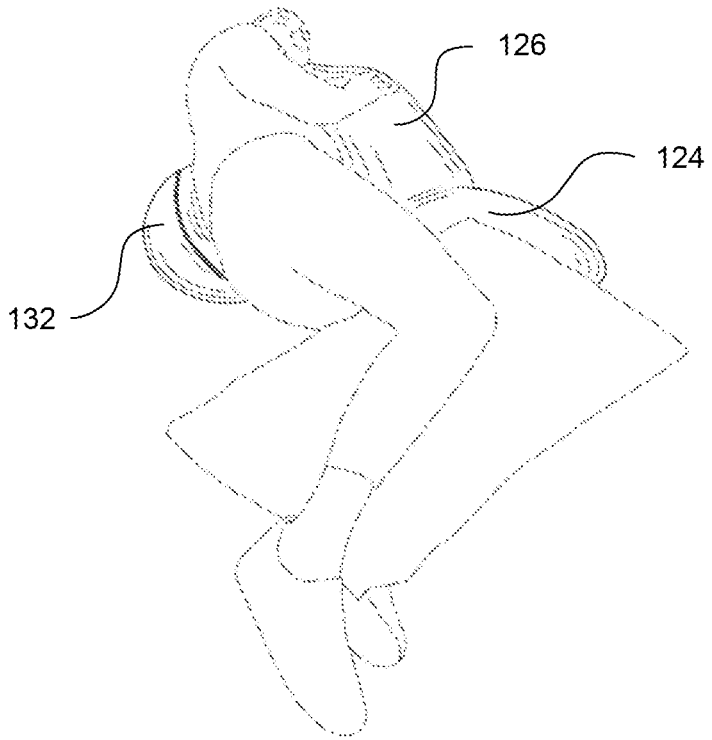

In FIG. 9, the user is lying atop the pillow system 100 facing the inner periphery of the slipcover 120. The user is lying atop the material band 130 with the pocket 132 and torso pillow 140 positioned adjacent the lower back and the lower portion 128 positioned under the user's head. The central portion 126 is positioned against the user's chest and the upper portion 124 is positioned in front or between the upper legs. A separate pillow may be positioned between the user's knees and/or legs.

Figure 10:
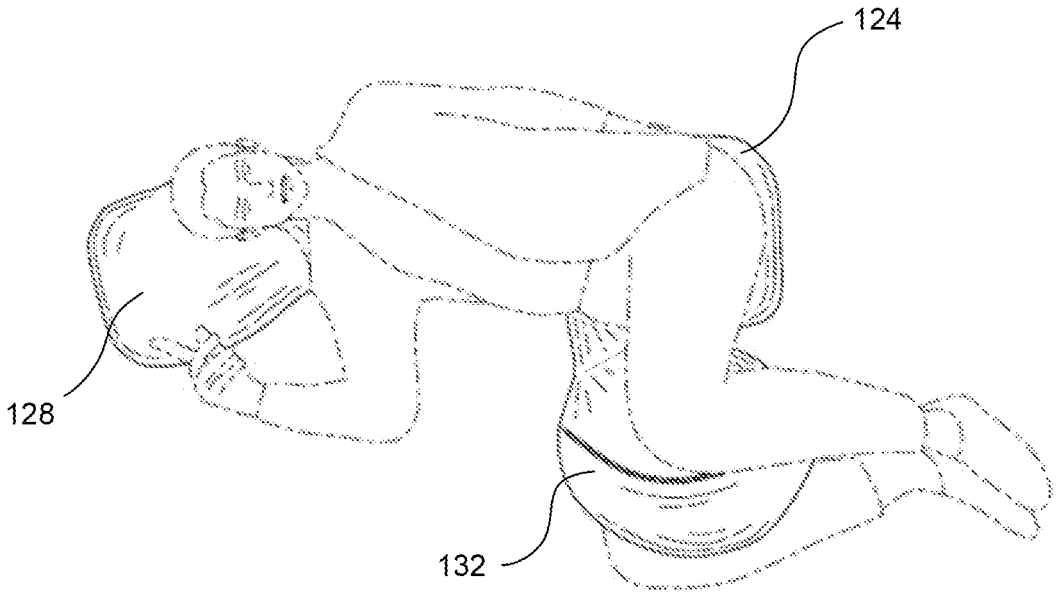

In FIG. 10, the user is lying atop the pillow system 100 facing the pocket 132. The user is lying atop the material band 130 with the pocket 132 and torso pillow 140 positioned between the user's knees. The lower portion 128 is positioned under the user's head and the central portion 126 and upper portion 124 are positioned against the user's back.

Figure 11:
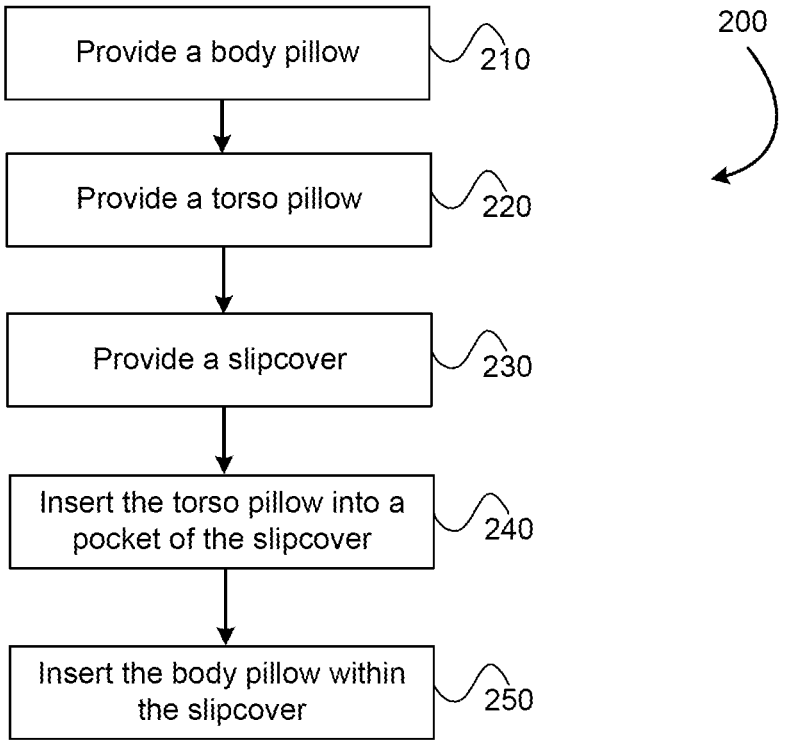
FIG. 11 illustrates a method of forming a multi-pillow support system.

FIG. 11 illustrates a method 200 of forming a pillow. At block 210, a body pillow is provided. The body pillow includes fill material and a fabric shell that surrounds the fill material. At block 220, a torso pillow is provided. The torso pillow includes fill material and a fabric shell that surrounds the fill material. The torso pillow is a separate pillow from the body pillow.

At block 230, a slipcover is provided. The slipcover has an outer periphery and an inner periphery and includes an upper portion, a lower portion, a central portion that is disposed or positioned between the upper portion and the lower portion, a pocket, and an elongate material band that operably connects the pocket with the central portion of the slipcover. At block 240, the torso pillow is inserted into the pocket of the slipcover so that the torso pillow is enclosed within the pocket. At block 250, the body pillow is inserted within the slipcover so that the body pillow is enclosed within the upper portion, the lower portion, and the central portion of the slipcover. The pocket is extendable from the inner periphery of the slipcover to position the torso pillow distally of the body pillow and thereby enable a user to lay atop the material band while the torso pillow and body pillow are positioned on opposite sides of the user's body.

In some embodiments, the upper portion, lower portion, and central portion of the slipcover are constructed of a first material and the material band is constructed of a second material that is different than the first material. In such instances, the second material of the material band is an elastic material that allows a distance of the pocket to be varied in relation to the inner periphery of the slipcover. As described herein, the slipcover may include a narrowed neck that is positioned between the central portion and the upper portion. In such instances, a proximal end of the material band may be connected to the narrowed neck of the slipcover.

As described herein, the body pillow may include a first inner wall that segments an upper section and a central section of the body pillow to prevent the fill material from migrating between the upper section and the central section of the body pillow. The body pillow may also include a second inner wall that segments the central section and a lower section of the body pillow to prevent the fill material from migrating between the central section and the lower section of the body pillow.

The invention has now been described in detail for purposes of clarity and understanding. However, it will be appreciated that certain changes and modifications may be practiced within the scope of the appended claims.

What is claimed is:

1. A pillow system, comprising:

an elongate pillow body comprising fill material and a fabric shell entirely surrounding and encasing the fill material, the pillow body having an outer periphery and an inner periphery;

wherein the pillow body has three sections consisting of:

an upper section;

a lower section; and a central section disposed between the upper section and the lower section;

wherein a first inner wall segments the upper section and the central section of the pillow body, the first inner wall having a diameter that is less than a diameter of the upper section and less than a diameter of the central section such that the pillow body is narrowed at the first inner wall; and wherein a second inner wall segments the central section and the lower section of the pillow body, the second inner wall having a diameter that is less than a diameter of the lower section and less than the diameter of the central section such that the pillow body is also narrowed at the second inner wall; and a slipcover that is positionable over the pillow body, wherein the slipcover includes an upper portion, a central portion, and a lower portion that correspond in shape and size with the upper section, the central section, and the lower section of the pillow body;

wherein the slipcover includes an opening on an outer periphery that allows the pillow body to be inserted into and removed from an interior of the slipcover; and wherein the fabric shell, the first inner wall, and the second inner wall of the pillow body prevent the fill material from migrating between the upper section, central section, and lower section of the pillow body and confine the fill material within the respective sections to maintain an even distribution of the fill material within the respective sections of the pillow body.

2. The pillow system of claim 1, wherein the slipcover comprises a narrowed neck between the central portion and the upper portion.

3. The pillow system of claim 2, wherein the slipcover further comprises a narrowed neck between the central portion and the lower portion.

4. The pillow system of claim 1, wherein the opening on the outer periphery of the slipcover extends from adjacent the upper portion and longitudinally along the slipcover below the lower portion.

5. The pillow system of claim 1, wherein the pillow body further comprises a contouring seam that facilitates in articulation of the upper section and lower section relative to the central section, wherein the contouring seam extends longitudinally along the pillow body between the outer periphery and the inner periphery.

6. The pillow system of claim 1, wherein the first inner wall and the second inner wall are attached to an inner peripheral wall of the pillow body.

7. The pillow system of claim 1, wherein the slipcover further comprises an additional opening within which a material band and a pocket are insertable for stowage, wherein the material band defines a channel between the pocket and the opening of the slipcover, the pocket being shaped and sized such that a torso pillow is insertable through the channel of the material band into the pocket.

8. The pillow system of claim 7, wherein the pocket comprises an elastic material that enables the torso pillow to be replaced with a different shaped and/or sized torso pillow.

9. A pillow system, comprising:

an elongate pillow body comprising fill material and a fabric shell surrounding the fill material, the pillow body having an outer periphery and an inner periphery;

wherein the pillow body includes:

an upper section that is configured to support a first portion of a user's body;

a lower section that is configured to support a second portion of the user's body;

a central section disposed between the upper section and the lower section;

a first inner wall that segments the upper section and the central section of the pillow body; and a second inner wall that segments the central section and the lower section of the pillow body;

wherein the first inner wall and second inner wall prevent the fill material from migrating between the upper section, the central section, and the lower section of the pillow body;

wherein the first inner wall has a diameter that is less than a diameter of the upper section and less than a diameter of the central section such that the pillow body is narrowed at the first inner wall;

wherein the second inner wall has a diameter that is less than a diameter of the lower section and less than the diameter of the central section such that the pillow body is also substantially narrowed at the second inner wall; and wherein the central section has a longitudinal length that is greater than a longitudinal length of the upper section or the lower section.

10. The pillow system of claim 9, further comprising a slipcover that is positionable over the pillow body, wherein the slipcover includes an upper portion, a central portion, and a lower portion that correspond in shape and size with the upper section, the central section, and the lower section of the pillow body, and wherein the slipcover includes an opening on an outer periphery that allows the pillow body to be inserted into and removed from an interior of the slipcover.

11. The pillow system of claim 10, wherein the slipcover comprises a narrowed neck between the central portion and the upper portion.

12. The pillow system of claim 11, wherein the slipcover comprises a second narrowed neck between the central section and the lower section of the slipcover.

13. The pillow system of claim 10, wherein the opening on the outer periphery of the slipcover extends from adjacent the upper portion and longitudinally along the slipcover below the lower portion.

14. The pillow system of claim 9, wherein the pillow body further comprises a contouring seam that facilitates in articulation of the upper section and lower section relative to the central section, wherein the contouring seam extends longitudinally along the pillow body between the outer periphery and the inner periphery.

15. The pillow system of claim 9, wherein the first inner wall and the second inner wall are attached to an inner peripheral wall of the pillow body.

16. The pillow system of claim 10, wherein the slipcover further comprises an additional opening within which a material band and pocket are insertable for stowage, wherein the material band defines a channel between the pocket and the opening of the slipcover, the pocket being shaped and sized such that a torso pillow is insertable through the channel of the material band into the pocket.

17. A pillow system, comprising:

an elongate pillow body comprising fill material and a fabric shell surrounding the fill material, the pillow body having an outer periphery and an inner periphery;

wherein the pillow body includes:

an upper section that is configured to support a first portion of a user's body;

a lower section that is configured to support a second portion of the user's body;

a central section disposed between the upper section and the lower section; and an inner wall that segments the central section and the upper section or lower section of the pillow body;

wherein the inner wall prevents the fill material from migrating between the central section and the upper section or lower section of the pillow body;

wherein the inner wall has a diameter that is less than a diameter of the central section and less than a diameter of the upper section or lower section such that the pillow body is narrowed at the inner wall; and wherein the central section has a longitudinal length that is greater than a longitudinal length of the upper section and greater than a longitudinal length of the lower section.

18. The pillow system of claim 17, wherein the inner wall is a first inner wall positioned between the upper section and the central section and wherein the pillow body includes a second inner wall positioned between the lower section and the central section, wherein the second inner wall has a diameter that is less than a diameter of the lower section and less than the diameter of the central section such that the pillow body is also narrowed at the second inner wall.

19. The pillow system of claim 17, further comprising a slipcover that is positionable over the pillow body, wherein the slipcover includes an upper portion, a central portion, and a lower portion that correspond in shape and size with the upper section, the central section, and the lower section of the pillow body, and wherein the slipcover includes an opening on an outer periphery that allows the pillow body to be inserted into and removed from an interior of the slipcover.

20. The pillow system of claim 19, wherein the slipcover comprises a narrowed neck between the central section and the upper section of the pillow body.

* * * * *